US005713311A

United States Patent [19]

Fitzgerald

[11] Patent Number: 5,713,311

[45] Date of Patent: Feb. 3, 1998

[54] HYBRID STEAM GENERATING SYSTEM AND METHOD

[75] Inventor: Francis D. Fitzgerald, Edison, N.J.

[73] Assignee: Foster Wheeler Energy International, Inc., Clinton, N.J.

[21] Appl. No.: 601,810

[22] Filed: Feb. 15, 1996

[51] Int. Cl.[6] ..... F22B 21/00; F22D 7/00

[52] U.S. Cl. ..... 122/406.5; 122/406.4; 122/6 A; 122/235.11

[58] Field of Search ..... 122/6 A, 235 C, 122/406.5, 510, 406.4, 235.11

[56] References Cited

U.S. PATENT DOCUMENTS

| | | | |
|---|---|---|---|
| 3,954,087 | 5/1976 | Stevens et al. | 122/406.5 |
| 3,992,172 | 11/1976 | Clark . | |
| 4,116,168 | 9/1978 | Gorzegno et al. . | |
| 4,175,519 | 11/1979 | Pratt et al. . | |
| 4,178,881 | 12/1979 | Pratt et al. . | |
| 4,184,455 | 1/1980 | Talmud et al. . | |
| 4,191,133 | 3/1980 | Stevens . | |
| 4,198,930 | 4/1980 | Pratt et al. . | |
| 4,241,585 | 12/1980 | Gorzegno . | |
| 4,287,430 | 9/1981 | Guido . | |
| 4,290,389 | 9/1981 | Palchik | 122/406.4 |
| 4,294,200 | 10/1981 | Gorzegno . | |
| 4,394,849 | 7/1983 | Pratt et al. . | |
| 4,430,962 | 2/1984 | Miszak . | |
| 4,473,035 | 9/1984 | Gorzegno . | |
| 4,495,899 | 1/1985 | Carberry . | |
| 4,520,762 | 6/1985 | Martin | 122/406.5 |
| 4,682,567 | 7/1987 | Garcia-Mallol et al. . | |
| 4,869,210 | 9/1989 | Wittchow | 122/406.5 |
| 5,056,468 | 10/1991 | Wittchow et al. . | |

*Primary Examiner*—Henry A. Bennett
*Assistant Examiner*—Gregory A. Wilson
*Attorney, Agent, or Firm*—Haynes and Boone, L.L.P.

[57] ABSTRACT

A hybrid steam generating system and method in which fluid is passed through the waterwall tubes of a furnace to transfer heat from the furnace to the fluid to convert at least a portion of the fluid to steam. Under certain operating conditions, the heated fluid is passed from the furnace to a separator for separating the steam from the heated fluid and the separated heated fluid is passed from the separator back to the furnace. The steam from the separator is passed to a steam utilization unit, and, under certain operating conditions, the heated fluid is passed from the furnace directly to the steam utilization unit.

42 Claims, 1 Drawing Sheet

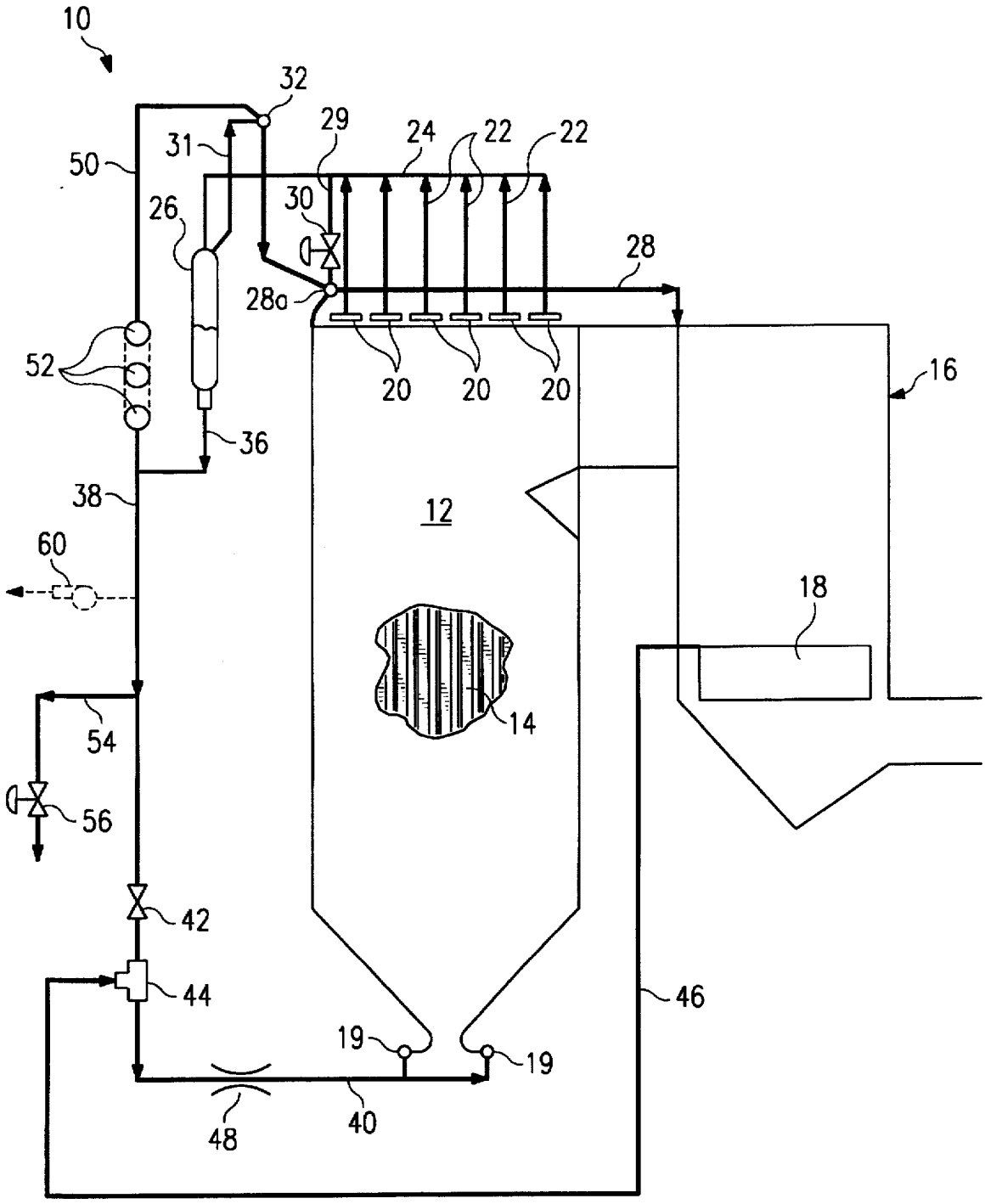
10
32
29
24
22
22
31
50
30
26
28
28a
52
20
20
20
16
36
38
12
60
18
14
54
56
42
44
46
19
19
48
40

HYBRID STEAM GENERATING SYSTEM AND METHOD

BACKGROUND OF THE INVENTION

The present invention relates to a steam generating system and method and, more particularly, to such a system and method which combines operating principles of both steam drum and once-through systems.

Drum type steam generators, especially of the natural circulation type, are well known and usually incorporate a relatively large steam drum which contains the steam-water separators, saturated liquid inventory, and a dry steam space. These type of arrangements are relatively simple to startup, provide failsafe protection of the waterwall enclosure as long as the drum/water accumulator has water to a safe level, and do not require a boiler circulating pump if their circuitry is designed to provide circulation of the cooling water by natural circulation. However, these generators have several limitations, including:

- relatively thick walls which limit the rate of pressure increase due to thermal stress limits
- relatively large diameter waterwall tubes, which contain a relatively large inventory of water requiting a large overfiring rate in order to change load and pressure simultaneously
- a relatively low maximum permitted operating pressure (which is normally approximately 2850 psig), due to difficulties in separating steam and water above that pressure, which precludes operation to supercritical pressures, as is required for advanced cycles.
- Relatively large fixed available superheater surface area downstream of the location of saturated steam enthalpy which makes it difficult to achieve design main steam temperatures at low loads.

The other main type of steam generator is a "once-through" unit which employs a boiler feed pump for pressurizing the system and forcing the liquid through the waterwall tubes. These systems are capable of operating to advanced, high pressures (5000 psig), and do not require large diameter, thick walled pressure vessels. As a result, the liquid inventory in the waterwalls, as well as the thermal stresses induced during fast temperature changes, are reduced. Also, the location at which saturated steam conditions exist over the load range is not fixed which permits main steam temperatures to be attained for all loads above the "once thru" load. Further, a once-through generator can take advantage of the combined oxygenated feedwater treatment method. However, these once-through systems are not without problems. For example their startup systems have generally been complicated to operate and expensive to install.

SUMMARY OF THE INVENTION

The present invention is a hybrid steam generator which combines the features of both a steam drum generator and a once-through generator while eliminating, or at least significantly reducing, the disadvantages thereof. To this end, fluid is passed through the waterwall tubes of a furnace to transfer heat from the furnace to the fluid to convert at least a portion of the fluid to steam. A separator is provided which, under certain operating conditions, receives the heated fluid from the furnace. The separator functions to separate the steam from the heated fluid and the remaining heated fluid is passed from the separator back to the furnace. A steam utilization unit receives the steam from the separator, and, under certain operating conditions, the heated fluid is passed from the furnace directly to the steam utilization unit.

BRIEF DESCRIPTION OF THE DRAWING

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings which is a schematic view of the system of the present invention.

DESCRIPTION OF THE PREFERRED EMBODIMENT

With reference to the drawing, the reference numeral 10 refers, in general, to a steam generator which includes a furnace 12 which may be of a conventional design and, as such, can be fired by oil, gas, or pulverized coal or by using a standard fluidized combustion process. The furnace 12 is formed, in part, by four upright walls each of which is formed by a plurality of waterwall tubes 14. Although not shown in the drawing, it is understood that the tubes 14 are multilead, internally ribbed (rifled), and have continuous external fins extending outwardly from diametrically opposed portions thereof, with the fins of adjacent tubes being connected together to form a gas-tight structure. Since this type of tube design is conventional, it will not be described in any further detail.

A heat recovery section, shown in general by the reference numeral 16, is located adjacent the furnace 12. The heat recovery section 16 includes a plurality of steam utilization units, such as superheaters, or the like (not shown), as well as an economizer 18 for supplying heated feedwater to the waterwall tubes 14, as will be explained.

A plurality of inlet headers 19 (two of which are shown) are connected to the lower ends of the tubes 14 for receiving heated feedwater for passing through the lengths of the tubes, and a plurality of outlet headers 20 are connected to the upper ends of the tubes 14 for receiving the heated water from the tubes. The outlet headers 20 are connected, via a corresponding number of risers 22, to a separator inlet pipe 24 which, in turn, is connected to a separator 26. Although only one separator 26 is shown and will be described for the convenience of presentation, it is understood that a plurality of separators and associated flow circuitry would normally be provided.

The furnace 12 has a roof 28, which is shown in dashed lines for the convenience of presentation, and which has an inlet header **28*a* disposed at one end thereof. The roof extends to, and is in fluid flow communication with the heat recovery area for passing the fluid to the latter area for further processing. A bypass pipe 29 extends from the separator inlet pipe 24 to the roof inlet header 28*a* and a control valve 30 is interposed therein. An outlet pipe 31 extends from the separator 26 to the roof inlet header 28*a* and a header 32 is interposed in the pipe 31**.

A drain pipe 36 extends from the separator 26 to a downcomer 38 which extends to a furnace feed pipe 40. A check valve 42 is interposed in the downcomer 38 along with a mixing tee 44 disposed downstream from the check valve. A conduit 46 connects the outlet of the economizer 18 to the mixing tee 44 for supplying feedwater to the tubes 14 in a manner to be described, and a monitoring device 48 is interposed in the pipe 40 for monitoring the flow of fluid through the latter pipe for reasons to be described. It is understood that the check valve 42 is operable by external circuitry which respond to various load conditions and other parameters to control its position, in a conventional manner.

A vent pipe 50 extends from the drain pipe 36 to the header 32 and a plurality of accumulators 52 are provided in the pipe 50 to increase the liquid inventory available for emergency use during transients. The accumulators 52 are approximately the same diameter and wall thickness as the separators(s) 26 and, although not clear from the drawing, are inclined with respect to the horizontal to provide continuity of liquid surface area of volume vs liquid height. The accumulators 52 are designed to emulate the function of a steam drum, without imposing the same thermal stress limits.

A bypass pipe 54 extends from the downcomer 38 and has a control valve 56 disposed therein for controlling bypass flow from the separator, as will be described. Although not shown in the drawings, it is understood that the bypass pipe 54 extends to a blowdown pipe, or the like (not shown).

In operation, from approximately 0 to 25% of the maximum continuous rated load (hereinafter referred to as "MCR load"), the steam generator 10 operates as a natural circulation drum unit. To this end, the valve 30 is closed, the valve 42 is open and the feedwater flows from the economizer 18 to the tee 44 and is passed to the headers 19 for passage upwardly through the waterwalls of the furnace 12 where it is heated from a temperature below saturated liquid conditions to form a two-phase mixture. The mixture is collected in the waterwall outlet headers 20 and is routed, via the risers 22 and the separator inlet pipe 24, to the separator 26. The separator 26 is designed for the full design pressure of the high pressure circuitry, and functions to separate the two-phase mixture into a saturated liquid stream and a wet steam stream at these low loads. The stream of wet steam leaving the separator 26 is routed through the pipe 31, the header 32 and to the roof inlet header 28a of the roof 28 for passage onto one or more downstream heat utilization units, such as superheaters, or the like (not shown), in the heat recovery area 16, with the final steam outlet temperature being controlled by the use of attemporator sprays in the heat recovery area 16. The separated saturated liquid discharging from the separator 26 passes through the drain pipe 36 and the downcomer 38 and mixes with the feedwater from the economizer 18 in the tee 44 before being passed to the inlet headers 19 for recirculation. During this operation, the feedwater flow is regulated in a manner to maintain a water level in the separator 26 sufficient to insure this recirculation of liquid from the separator. The flow rate of the recirculated liquid flow from the separator 26 is governed by the heat absorption of the furnace waterwalls, the sizing of the drain pipe 36 and the downcomer 38, and the pressure drop through the system of heated and unheated risers. To the extent necessary, steam temperature is controlled by attemporator sprays in the heat recovery section 16, in a conventional manner.

From approximately 25% to 50% MCR load, the unit operates both as a natural circulation unit and a once-through unit. As such, the rate of the fluid entering the separator 26, and therefore the fluid level in the separator, is controlled by opening the valve 30 to the extent that a portion of the two-phase mixture from the risers 22 and the separator inlet pipe 24 bypasses the separator and rather is circulated directly to the roof inlet header 28a. Thus, the mixture mixes with the steam received directly from the separator 26 in the header 28a before passing downstream through the roof 28 to the heat recovery area 16, as described above. The feedwater from the economizer 18 continues to mix with the recirculated saturated liquid from the separator 26 in the tee 44 before being passed to the inlet headers 19 for recirculation. During this operation, and beginning at approximately 33% MCR, the operating pressure in the furnace 12 increases in proportion to increases in load up to and including approximately 95% MCR. The feedwater flow rate is varied in parallel with the firing rate to control the temperature of the steam output in a "once through" control mode for all loads above 25% MCR.

From approximately 50% to 100% MCR load, the valve 30 is completely opened to partially bypass the separator and thus reduce the pressure drop across the separator at high loads. There will be two flow paths of the two phase fluid—one through the separator 26 and the other through the bypass conduit 29, with the flow distribution through each being related to their relative flow resistance. The valve 42 is closed, thus terminating recirculation of the saturated liquid from the separator 26 to the tee 44 and to the inlet headers 19. Thus, the water level in the separator 26 is not controlled at loads above 50% MCR and there is no recirculated flow of the liquid from the separator back to the waterwalls of the furnace 12. The feedwater flow rate continues to be varied in parallel with the firing rate to control the temperature of the steam output. Thus, this phase of the operation is essentially the same as that for a once-through system.

Thus, the key operating parameters for the various load conditions are as follows with the understanding that the MCR percentages set forth are approximate:

| | 0–25% MCR LOAD | 25–50% MCR LOAD | 50–100% MCR LOAD |
|---|---|---|---|
| TYPE OF OPERATION | NATURAL CIRCULATION | NATURAL CIR./ ONCE-THROUGH | ONCE-THROUGH |
| SEPARATOR BYPASS | NONE | THROTTLED | FULLY OPEN |
| FURNACE PRESSURE | CONSTANT | CHANGES WITH LOAD | CHANGES WITH LOAD |
| SEPARATOR FLUID LEVEL CONTROL | FEEDWATER CONTROL | CONTROL OF VALVE 30 | NONE |

During emergencies, such as when transients occur during operation, the accumulators 52 receive liquid from, or discharge liquid to, the drain pipe 36. Since the accumulators 52 are designed to emulate the function of the steam drum without imposing the same thermal stress limits, disruption of waterwall circulation and possible distress of the heated waterwall tubes in response to routine transients in the feedwater flow or firing rate is avoided.

The present invention enjoys several advantages, examples of which are as follows:

1. The steam generator 10 is relatively simple to start up, provides fail safe protection of the waterwall enclosure as long as the separator 26 or the water accumulator 52 has water to a safe level, and does not require a boiler recirculating pump.
2. The diameter and wall thickness of the separator(s) 26 is limited to moderate values, thus reducing the thermal stresses generated during fast changes in fluid temperature.
3. The bypass pipe 54 and the control valve 56 can also be used to help ensure a steady minimum feedwater flow rate during low load operations, since the valve could be programmed to control to a high separator water level.

4. The monitoring device 48 can provide an indication that feedwater is bypassing the generator 10 and flowing into and through the downcomer 38 and that the valve 42 should be closed.
5. The steam generator can operate at relatively high pressures without the necessity of maintaining a relatively large liquid inventory in the waterwalls.
6. The location at which saturated steam conditions exist over the load range is not fixed which permits main steam temperatures to be designed for all loads above the "once thru" load.

It is understood that several variations may be made in the foregoing without departing from the scope of the invention. For example, although, in the example set forth above, the roof 28 is located immediately downstream of the separator 26, a upper furnace steam-cooled enclosure wall can be interposed between the outlet of the separator 26 and the roof. Thus, the wet steam from the separator 26 would be fed to the latter enclosure wall prior to passing to the roof 28. In this case the upper furnace enclosure wall would utilize two distinct passes: a two-phase pass which is a continuation of the lower furnace pass, and a wet steam-cooled pass.

Further, it is understood that the present invention is not limited to the use of vertical waterwall tubes and the particular operating conditions set forth above including the specific ranges set forth in the table. For example, the waterwalls can be formed by spiral wound tubes as disclosed in U.S. Pat. No. 4,191,133 and No. 4,344,388 both of which are assigned to the assignee of the present invention and both of which are hereby incorporated by reference. According to this arrangement, the pressure in the steam generator 10 is held constant during relative low loads, is varied linearly during intermediate loads and is held a relatively high constant pressure in the relatively high load range. Also, the two-pass upper furnace circuit described above could be used.

It is further understood that the present invention is not limited to the use of the control valve 30 to bypass the separator 26 during the conditions described above. Rather, the suction inlet of a relatively small spray water pump 60 can be connected to the downcomer 38 upstream of the valve 42. In the above described load range of 25–50% MCR, while the check valve 42 is open, the pump 60 would control the fluid level in the separator 26 by spraying the excess separator liquid into a superheater, or the like, located in the heat recovery section 16 based on the water level in the separator 26.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A steam generating system comprising a furnace at least a portion of the walls of which are formed by tubes each of which has an inlet and an outlet, a first fluid flow circuit for introducing fluid into said inlets of said tubes for passage through said tubes to transfer heat from said furnace to said fluid to convert at least a portion of said fluid to steam, a separator for separating said steam from said fluid, a second fluid flow circuit for connecting the outlets of the tubes with the separator under certain operating conditions to transfer the heated fluid from the tubes to the separator, and a third fluid flow circuit for connecting the separator with the inlets of the tubes for transferring at least a portion of the separated heated fluid from the separator to the inlets of the tubes for recirculation through the furnace, the second fluid flow circuit comprising a bypass circuit for passing at least a portion of the heated fluid from the outlets of the tubes directly to the steam utilization unit under certain operating conditions.

2. The system of claim 1 further comprising a flow circuit for passing the separated steam from the separator to a steam utilization unit.

3. The system of claim 1 wherein the fluid introduced by the first fluid flow circuit to the inlets of the tubes is feedwater, and further comprising means for mixing the feedwater with the separated heated fluid from the third fluid flow circuit before the feedwater and the separated heated fluid are transferred to the inlets of the tubes.

4. The system of claim 1 wherein the third fluid flow circuit comprises a valve for terminating flow of the separated heated fluid from the separator to the inlets of the tubes.

5. The system of claim 4 further comprising a bypass conduit associated with the valve for passing the separated heated fluid from the separator externally of the furnace.

6. The system of claim 1 wherein the tubes are multi lead and internally ribbed.

7. A steam generating system comprising a furnace at least a portion of the walls of which are formed by tubes each of which has an inlet and an outlet, a first fluid flow circuit for introducing fluid into said inlets of said tubes for passage through said tubes to transfer heat from said furnace to said fluid to convert at least a portion of said fluid to steam, a separator for separating said steam from said fluid, a second fluid flow circuit for connecting the outlets of the tubes with the separator under certain operating conditions to transfer the heated fluid from the tubes to the separator, a third fluid flow circuit for connecting the separator with the inlets of the tubes for transferring at least a portion of the separated heated fluid from the separator to the inlets of the tubes for recirculation through the furnace, the second fluid flow circuit comprising a bypass circuit for at least partially bypassing the separator under certain operating conditions, and at least one accumulator connected in the second flow circuit in parallel with the separator for receiving the separated heated fluid from the separator under certain operating conditions.

8. The system of claim 1 further comprising a flow circuit for passing the separated steam from the separator to a steam utilization unit.

9. The system of claim 8 wherein the bypass circuit passes the heated fluid from the outlets of the tubes directly to the steam utilization unit.

10. The system of claim 1 wherein the fluid introduced by the first fluid flow circuit to the inlets of the tubes is feedwater, and further comprising means for mixing the feedwater with the separated heated fluid from the third fluid flow circuit before the feedwater and the separated heated fluid are transferred to the inlets of the tubes.

11. The system of claim 7 wherein the third fluid flow circuit comprises a valve for terminating flow of the separated heated fluid from the separator to the inlets of the tubes.

12. The system of claim 11 further comprising a bypass conduit associated with the valve for passing the separated heated fluid from the separator externally of the furnace.

13. The system of claim 7 wherein the tubes are multi lead and internally ribbed.

14. A steam generating method comprising the steps of passing fluid through waterwall tubes of a furnace to transfer heat from the furnace to the fluid to heat the fluid and convert at least a portion of the fluid to steam, passing the steam and the heated fluid from the furnace to a separator under certain operating conditions, separating the steam from the heated fluid in the separator, passing the separated heated fluid from the separator back to the furnace, passing the separated steam from the separator directly to a steam utilization unit, and passing at least a portion of the steam and the heated fluid from the furnace directly to the steam utilization unit under other operating conditions.

15. The method of claim 14 further comprising the step of terminating the third step of passing in response to certain operating conditions.

16. The method of claim 15 further comprising the step of passing the separated heated fluid externally of the furnace in response to the step of terminating.

17. The method of claim 14 wherein the last step of passing includes the step of at least partially bypassing the separator.

18. The method of claim 14 further comprising the step of mixing feedwater with the separated heated fluid before the separated heated fluid is passed back to the furnace.

19. The method of claim 14 wherein the conditions are load conditions.

20. The method of claim 19 wherein the first step of passing is under relative low load conditions and wherein the last step of passing is under relatively high load conditions.

21. The method of claim 14 further comprising the steps of connecting an accumulator in parallel with the separator and passing the separated heated fluid to the accumulator under certain operating conditions.

22. The method of claim 14 wherein, for all loads below 50% of the maximum continuous rated load, the step of passing the separated heated fluid from the separator back to the furnace is by natural circulation.

23. A steam generating method comprising the steps of passing fluid through waterwall tubes of a furnace to transfer heat from the furnace to the fluid to convert at least a portion of the fluid to steam, passing the steam and the heated fluid from the furnace to a separator for separating the steam from the heated fluid, passing the separated heated fluid from the separator back to the furnace, passing the steam from the separator directly to a steam utilization unit, passing the steam and the heated fluid from the furnace directly to the steam utilization unit under predetermined operating conditions, maintaining a constant furnace pressure under certain load conditions, and varying the furnace pressure during other load conditions.

24. The method of claim 23 wherein the furnace pressure is varied in proportion to variations in load.

25. The method of claim 23 wherein the certain load conditions are relatively low load conditions and wherein the other load conditions are relatively high load conditions.

26. The method of claim 23 wherein, for all loads below 50% of the maximum continuous rated load, the step of passing the separated heated fluid from the separator back to the furnace is by natural circulation.

27. A steam generating method comprising the steps of introducing feedwater into the waterwall tubes of a furnace to transfer heat from the furnace to the fluid to convert at least a portion of the fluid to steam, passing the heated fluid from the furnace to a separator for separating the steam from the heated fluid, passing the separated heated fluid from the separator back to the furnace, passing the separated steam from the separator directly to steam utilization unit, controlling the fluid level in the separator under certain load conditions by varying the flow rate of the feedwater, and controlling the fluid level of the separator under other load conditions by at least partially bypassing the separator by passing a portion of the heated fluid from the furnace directly to the steam utilization unit.

28. The method of claim 27 wherein the certain load conditions are relatively low load conditions and wherein the other load conditions are relatively high load conditions.

29. The method of claim 27 further comprising the step of maintaining a constant furnace pressure under predetermined load conditions and varying the furnace pressure during other predetermined load conditions.

30. The method of claim 29 wherein the predetermined load conditions are relatively low load conditions and wherein the other predetermined load conditions are relatively high load conditions.

31. The method of claim 27 wherein the certain load conditions substantially correspond to the predetermined load conditions and wherein the other load conditions substantially correspond to the other predetermined load conditions.

32. The method of claim 27 wherein, for all loads below 50% of the maximum continuous rated load, the step of passing the separated heated fluid from the separator back to the furnace is by natural circulation.

33. A steam generating system comprising a furnace at least a portion of the walls of which are formed by tubes each of which has an inlet and an outlet, a first fluid flow circuit for introducing fluid into the inlets of the tubes for passage through the tubes to transfer heat from the furnace to the fluid to convert at least a portion of the fluid to steam, a separator for separating the steam from the fluid, a second fluid flow circuit for connecting the outlets of the tubes with the separator under certain operating conditions to transfer the heated fluid from the tubes to the separator, and a third fluid flow circuit for connecting the separator with the inlets of the tubes for transferring at least a portion of the separated heated fluid from the separator to the inlets of the tubes for recirculation through the furnace, means associated with the third fluid flow circuit for passing a portion of the separated heated fluid from the third fluid circuit to regulate the fluid level in the separator, and at least one accumulator connected in the second flow circuit in parallel with the separator for receiving the separated heated fluid from the separator under certain operating conditions.

34. The system of claim 33 further comprising a heat recovery area for receiving the latter portion of the separated heated fluid from the means.

35. The system of claim 33 wherein the means is a pump having its suction inlet connected to the third fluid flow circuit.

36. The system of claim 33 wherein the fluid introduced by the first fluid flow circuit to the inlets of the tubes is feedwater, and further comprising means for mixing the feedwater with the separated heated fluid from the third fluid flow circuit before the feedwater and the separated heated fluid are transferred to the inlets of the tubes.

37. The system of claim 33 wherein the tubes are multi lead and internally ribbed.

38. A steam generating method comprising the steps of passing fluid through waterwall tubes of a furnace to transfer heat from the furnace to the fluid to heat the fluid and convert at least a portion of the fluid to steam, passing the steam and the heated fluid from the furnace to a separator under certain operating conditions, separating the steam from the heated fluid in the separator, passing the separated steam from the separator directly to a steam utilization unit, passing the separated heated fluid from the separator back to the furnace under certain operating conditions, and passing at least a portion of the separated heated fluid from the separator to a heat recovery area under other operating conditions.

39. The method of claim 38 further comprising the step of at least partially bypassing the separator under other operating conditions.

40. The method of claim 38 further comprising the step of mixing feed-water with the separated heated fluid before the separated heated fluid is passed back to the furnace.

41. The method of claim 38 wherein the conditions are load conditions.

42. The method of claim 38 wherein, for all loads below 50% of the maximum continuous rated load, the step of passing the separated heated fluid from the separator back to the furnace is by natural circulation.

* * * * *